US010984779B2

(12) United States Patent
Cho et al.

(10) Patent No.: US 10,984,779 B2
(45) Date of Patent: Apr. 20, 2021

(54) AUDIO ADJUSTMENT METHOD AND ASSOCIATED AUDIO ADJUSTMENT DEVICE FOR ACTIVE NOISE CANCELLATION

(71) Applicant: Realtek Semiconductor Corp., HsinChu (TW)

(72) Inventors: Chun-Ming Cho, Hsinchu (TW); Wei-Hung He, Hsinchu (TW)

(73) Assignee: Realtek Semiconductor Corp., HsinChu (TW)

( * ) Notice: Subject to any disclaimer, the term of this patent is extended or adjusted under 35 U.S.C. 154(b) by 0 days.

(21) Appl. No.: 16/827,616

(22) Filed: Mar. 23, 2020

(65) Prior Publication Data

US 2020/0335078 A1 Oct. 22, 2020

(30) Foreign Application Priority Data

Apr. 18, 2019 (TW) ..... 108113494

(51) Int. Cl.
*G10K 11/178* (2006.01)
*H04R 1/10* (2006.01)

(52) U.S. Cl.
CPC .. *G10K 11/17854* (2018.01); *G10K 11/17873* (2018.01); *G10K 2210/1081* (2013.01);
(Continued)

(58) Field of Classification Search
CPC ... H04R 3/02; H04R 3/04; H04R 3/06; H04R 3/08; H04R 3/14; H04R 3/007;
(Continued)

(56) References Cited

U.S. PATENT DOCUMENTS

2010/0014685 A1* 1/2010 Wurm ..... G10K 11/178 381/71.11
2015/0030166 A1* 1/2015 Ranieri ..... H04R 29/005 381/58

(Continued)

OTHER PUBLICATIONS

Kuo, "Active Noise Control: A Tutorial Review", IEEE, USA, Jun. 1999.

(Continued)

*Primary Examiner* — Leshui Zhang
(74) *Attorney, Agent, or Firm* — Winston Hsu

(57) ABSTRACT

The present invention provides an audio adjustment method and associated audio adjustment device for active noise cancellation. The audio adjustment method includes: broadcasting a single tone having a frequency $f_k$; generating M sets of filtering coefficients regarding the frequency $f_k$, wherein each set of filtering coefficients within the M sets of filtering coefficients includes a combination of an amplitude and a phase, and the M sets of filtering coefficients are different from one another; determining an $m^{th}$ set of filtering coefficients from the M sets of filtering coefficients to minimize energy corresponding to the frequency $f_k$; and adjusting the single tone with the $m^{th}$ set of filtering coefficients to obtain an adjusted single tone corresponding to the frequency $f_k$.

9 Claims, 2 Drawing Sheets

(52) U.S. Cl.
CPC ..... *G10K 2210/3027* (2013.01); *G10K 2210/3028* (2013.01)

(58) Field of Classification Search
CPC ..... H04R 5/04; H04R 25/453; H04R 25/50; H04R 25/505; H04R 25/507; H04R 1/1091; H04R 1/10; H04R 1/08; H04R 29/001; H04R 3/00; H04R 3/002; H04R 2420/07; H04R 2499/11; H04R 2217/03; H04R 2225/41; H04R 1/1083; H04R 2410/01; H04R 2410/05; H04R 2225/43; H03G 5/00; H03G 5/005; H03G 5/16; H03G 5/165; H03G 5/24; H03G 5/28; H03G 9/005; H03G 9/24; H03G 9/025; H03G 2201/702; H03G 7/007; G06F 3/165; G06F 17/3074; G10K 11/01; G10K 11/36; G10K 11/175; G10K 11/178; G10K 11/1787; G10K 11/17873; G10K 11/17875; G10K 11/17879; G10K 11/17881; G10K 2210/3028; G10K 2210/30281; G10K 11/17854; G10K 11/17853; G10K 11/1785; G10K 11/17815; G10K 11/17883; G10K 11/17885
USPC .. 381/28, 59, 55, 317, 318, 321, 74, 72, 26, 381/56, 57, 71.1–71.13, 83, 332, 93, 96, 381/97, 98, 99, 100, 101, 102, 103, 106, 381/107, 108, 120, 121; 372/551, 552, 372/553, 555; 379/406.01–406.16; 704/E21.007, E21.02; 700/94
See application file for complete search history.

(56) References Cited

U.S. PATENT DOCUMENTS

2016/0099783 A1* 4/2016 Ku ..... H04B 1/62 455/114.2
2019/0037324 A1* 1/2019 Darlington ..... H04R 1/08

OTHER PUBLICATIONS

Gether, "Design an ANC headset using the AS3415", EDN Network, USA, Apr. 8, 2014.

* cited by examiner

AUDIO ADJUSTMENT METHOD AND ASSOCIATED AUDIO ADJUSTMENT DEVICE FOR ACTIVE NOISE CANCELLATION

BACKGROUND OF THE INVENTION

1. Field of the Invention

The present invention is related to audio adjustment methods and associated devices, and more particularly, to a method and an associated device which can improve noise cancellation effect of active noise cancellation (ANC) earphones.

2. Description of the Prior Art

When listening to music with earphones, noise cancellation functions are extremely important. Passive nose cancellation via material(s) or a structure of the earphone can slightly reduce the volume of noise being transmitted to the ears. For specific types of noise such as unpleasant voices or specific frequencies, however, the improvement is not significant. In comparison with passive noise cancellation, active noise cancellation (ANC) provides extra noise cancellation effect. ANC has therefore become popular for earphone products.

The first issue in the development of ANC earphone products is that accurate adjustment for the particular level of noise cancellation is required. Responses caused by the earphone mechanism, components, and materials of the earplugs/earmuffs are often referred to as primary path response. Some related arts consider the influence of all the above factors, and thereby inevitably need expensive precision instruments (e.g. audio analyzers) for noise cancellation implementation.

SUMMARY OF THE INVENTION

To solve the problems of the high costs of precision instruments, the present invention proposes a scheme with low cost and high noise cancellation effects, which can solve the problem of the related art without introducing any side effect or in a way that is less likely to introduce side effects.

One embodiment of the present invention provides an audio adjustment method for active noise cancellation, comprising: broadcasting a single tone having a frequency $f_k$; generating M sets of filtering coefficients regarding the frequency $f_k$, wherein each set of filtering coefficients within the M sets of filtering coefficients comprises a combination of an amplitude and a phase, and the M sets of filtering coefficients are different from one another; determining an $m^{th}$ set of filtering coefficients from the M sets of filtering coefficients to minimize energy corresponding to the frequency $f_k$; and adjusting the single tone with the $m^{th}$ set of filtering coefficients to obtain an adjusted single tone corresponding to the frequency $f_k$.

Another embodiment of the present invention provides an audio adjustment device. The audio adjustment device comprises an external audio source, an earphone, an artificial head device and an audio adjustment circuit. The external audio source is configured to broadcast a single tone having a frequency $f_k$. The artificial head device comprises an audio receiver, and is configured to receive the single tone, wherein the earphone is positioned on the artificial head device. The audio adjustment circuit is coupled to the artificial head device, and is configured to perform the following operations: generating M sets of filtering coefficients regarding the frequency $f_k$, wherein each set of filtering coefficients within the M sets of filtering coefficients comprises a combination of an amplitude and a phase, and the M sets of filtering coefficients are different from one another; determining an $m^{th}$ set of filtering coefficients from the M sets of filtering coefficients to minimize energy corresponding to the frequency $f_k$; and adjusting the single tone with the $m^{th}$ set of filtering coefficients to obtain an adjusted single tone corresponding to the frequency $f_k$ for being broadcasted by the earphone.

To summarize, the audio adjustment method and the audio adjustment device of the present invention can enhance the effect of active noise cancellation earphones with high fault tolerance and lower costs in comparison with the related art.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims, which refer to particular components. As one skilled in the art will appreciate, electronic equipment manufacturers may refer to a component by different names. This document does not intend to distinguish between components that differ in name but not in function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

The present invention proposes an active noise cancellation (ANC) circuit comprising a feedforward filter. The purpose of this design is to minimize environmental noise within a voice broadcast by a speaker, by utilizing a simple filter (e.g. an all-pass filter (APF)) and trial and error performed on multiple sets of different frequencies in order to obtain an optimal noise cancellation effect. The feedforward filter is designed to imitate a main path response, which utilizes a voice received by an external microphone to generate anti-noise through filter calculation, and a speaker can then broadcast the voice plus the anti-noise, thereby achieving the effect of noise cancellation. The present invention is described in more detail in the following.

Figure 1:
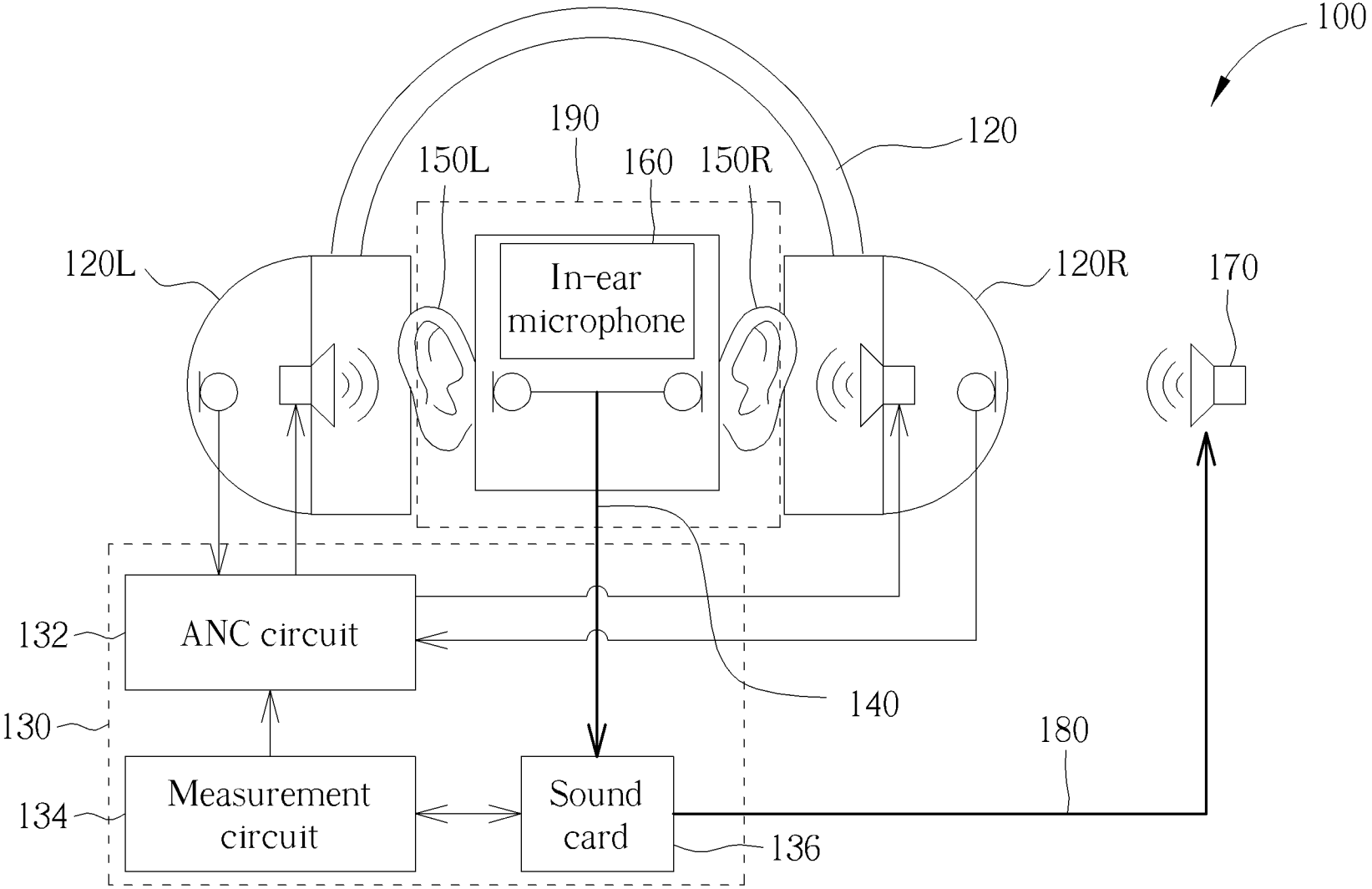
FIG. 1 is a diagram illustrating an audio adjustment device according to an embodiment of the present invention.

Refer to FIG. 1, which is a diagram illustrating an audio adjustment device 100 according to an embodiment of the present invention. As shown in FIG. 1, the audio adjustment device 100 comprises an earphone (or headphone) 120 to be tested, an artificial head device 190, an audio adjustment circuit 130 and an external audio source 170. The earphone 120 may be wired or wireless earphones (e.g. Bluetooth earphones), and comprise earmuffs 120L and 120R (the "earmuffs" here may be referred to as "earplugs" for in-ear earphones). The artificial head device 190 comprises artificial ears 150L, 150R and an in-ear microphone 160. The audio adjustment circuit 130 comprises an ANC circuit 132, a measurement circuit 134 and a sound card 136. In other embodiment of present invention, the ANC circuit 132 is included in the earphone 120, and the measurement circuit 134 and the sound card 136 are included in the audio adjustment circuit 130. The sound card 136 and the in-ear microphone 160 are connected to each other via an audio source wire 180, and the in-ear microphone 160 is for receiving voices to simulate a scenario of human ears hearing voices. Note that the artificial ears 150L and 150R imitate the mechanisms of human ears, and are applicable to the adjustment of headphones or earphones (in-ear earphones). A shape of the artificial head device 190 may be similar to a real head, or merely a columnar object. For a headphone, an object having sound insulation effects should be used during testing; for an in-ear earphone, the aforementioned real head shape or columnar object is not necessary during testing, and only a device that is capable of imitating two ear canals is needed to replace the artificial head device 190. In comparison with the expensive instruments utilized in the related art, the external audio source 170 may be implemented by an ordinary speaker. In addition, it should be noted that the effects of the measurement circuit 134 may be implemented by software tools; i.e. the present invention may utilize computer programs to achieve the same purposes, rather than being limited to installing the measurement circuit and the sound card via hardware.

In this embodiment, an ANC response is tested under a condition where the earphone 120 has been assembled and worn by a user, but the present invention is not limited thereto. For establishing a testing environment, the artificial head 190 (or the artificial ears 150L and 150R) is required, and the in-ear microphone receives sound internally. The above operations are preferably undergone in an anechoic chamber, which provides further sound insulation against the external environment in order to maintain measurement accuracy. The present invention is not limited to measure only one of the artificial ears 150L and 150R at one time. The present invention may measure both the artificial ears 150L and 150R concurrently. In addition, although the above examples comprise tests of both left and right ears, the present invention may perform a single side test on the earphone, and the method of the present invention is applicable to a single-ear earphone.

The ANC circuit 132 may comprise a digital circuit with filtering functions, which allows the outside measurement circuit 134 to modify filtering coefficient(s) via a control interface, such as a control interface conforming to Universal Asynchronous Receiver/Transmitter (UART), Inter-integrated circuit (I2C) or Bluetooth (BT) specifications. The sound card 136 may be built-in or external, and can implement functions of broadcasting and recording. The ANC circuit 132 may be regarded as comprising a filter with changeable filtering coefficients, and the filtering effect may vary due to different settings of the filtering coefficients.

Figure 2:
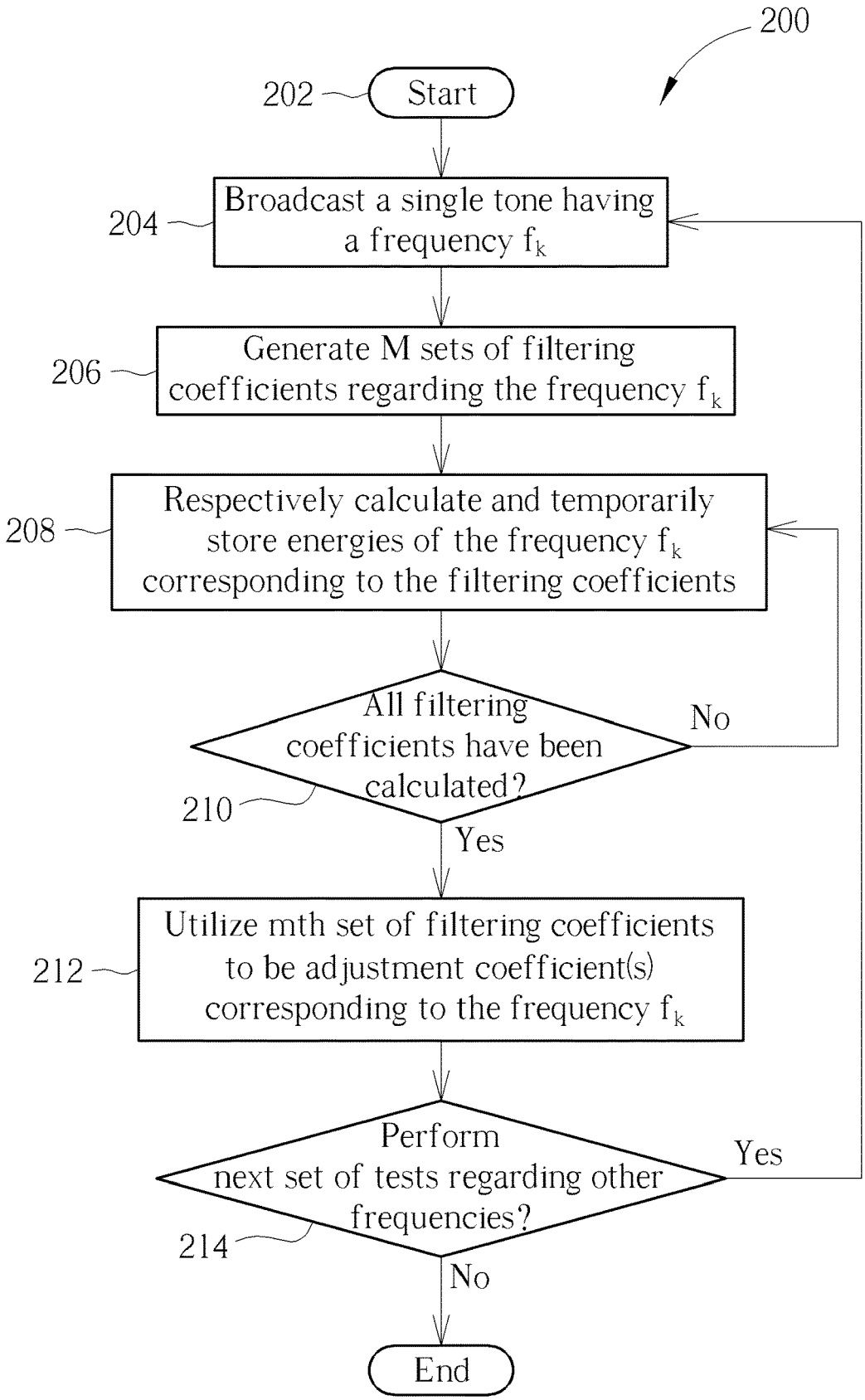
FIG. 2 is a flowchart illustrating a method for testing an earphone according to an embodiment of the present invention.

Refer to FIG. 2, which is a flowchart illustrating a method 200 for testing the earphone 120 according to an embodiment of the present invention. Note that, these steps do not have to be performed in the order shown in FIG. 2 if the result is substantially the same. The method 200 shown in FIG. 2 may be adopted by the audio adjustment device 100, and may be briefly summarized as follows:

Step 202: start.

Step 204: broadcast a single tone having a frequency $f_k$.

Step 206: generate M sets of filtering coefficients regarding the frequency $f_k$, where each set of filtering coefficient $H_m[k]$ comprises a combination of different amplitudes (volumes) and phases of the frequency $f_k$, where m=1-M. This step may be executed by the measurement circuit 134, and the filtering coefficients can be configured in the ANC circuit 132.

Step 208: respectively calculate and temporarily store energies of the frequency $f_k$ corresponding to the filtering coefficients (e.g. the M sets of filtering coefficients), in order to perform comparisons for obtaining an $m^{th}$ set of filtering coefficients from the filtering coefficients (e.g. the M sets of filtering coefficients) which corresponds to an optimal coefficient (e.g. an optimal set of filtering coefficients). The $m^{th}$ set of filtering coefficients minimizes the energy $P_m=E(|c_k*r_m|^2)$ corresponding to the frequency $f_k$, where $r_m$ is an audio signal received based on the $m^{th}$ set of filtering coefficients, $c_k$ is a band-pass filter (BPF) coefficient regarding $f_k$, and E is a function symbol.

Step 210: check whether all filtering coefficients have been calculated (e.g. determine whether the current set of filtering coefficients is the last set of filtering coefficients, i.e. the $M^{th}$ set of filtering coefficients), wherein if yes, the flow enters Step 212. If no, the flow enters Step 208.

Step 212: utilize the $m^{th}$ set of filtering coefficients to be adjustment coefficient(s) corresponding to the frequency $f_k$, where an amplitude and a phase corresponding to the $m^{th}$ set of filtering coefficients represent a frequency response of $f_k$.

Step 214: determine whether to perform the next set of tests regarding another frequency (or other frequencies); if yes, the flow returns to Step 204; if no, the flow is finished.

A range of the frequency $f_k$ may be 20 Hz-3 kHz (the main range of active noise cancellation) in one example, but the present invention is not limited thereto. In Step 208, the function symbol E may represent obtaining an expected value, e.g. calculating the average signal energy of the audio signal $r_m$ after passing through the bandpass filter, but the present invention is not limited thereto (other methods can be adopted to obtain the average value). In addition, the flow shown in FIG. 2 can be repeatedly executed to calculate noise cancellation coefficients corresponding to respective frequencies, and thereby obtain optimal noise cancellation responses of all test frequencies. After obtaining the optimal noise cancellation responses, the filtering coefficient (e.g. the set of filtering coefficients) of the ANC circuit is thereby determined. Feedforward optimal noise cancellation responses of respective frequencies estimated via the aforementioned method may be configured to generate a set of filtering coefficients with noise cancellation effect. There are many ways to generate filtering coefficients. For example, the present invention may utilize functions of MATLAB such as invfreqz and fitfrd to generate coefficients, and these coefficients may be applied to various types of chips having the same function (or be directly implemented via digital signal processing (DSP)) in order to implement the noise cancellation effect. In addition, the present invention is not limited to the manner of generating multiple sets of coefficients as shown in Step 206; various types of algorithms may be adopted for implementation, where the amplitudes and phases corresponding to these coefficients should be different in order to prevent calculating repeated values.

Regarding the optimal coefficient described in Step 208, it may be comprehended as the set of filtering coefficients having the best effect regarding the frequency $f_k$ within the multiple sets of filtering coefficients that have been tried.

This set of filtering coefficients is the best only for the particular frequency $f_k$, rather than for other frequencies; thus, the amplitude and phase corresponding to the $m^{th}$ set of filtering coefficients need to be recorded as the frequency response of the frequency $f_k$. The ANC coefficient(s) adopted by the ANC circuit 132 is designed regarding all the obtained frequency responses in order to make all frequencies be as close to the frequency response as possible. For example, regarding all N frequencies including the frequency $f_k$, N specific filtering coefficients (e.g. N sets of specific filtering coefficients) which minimize energies of the N frequencies can be obtained, and a final ANC coefficient (e.g. a final set of ANC coefficients) can be determined according to the frequency responses of N frequencies. The final ANC coefficient is used in order to perform overall audio adjustment. This final ANC coefficient can be stored in the chip of the earphone.

In one embodiment, the present invention may be implemented in a laboratory (e.g. an anechoic chamber). Thus, after the coefficient(s) of the earphone 120 are obtained, the audio adjustment circuit 130 does not need to be designed within the earphone 120. In another embodiment, the audio adjustment circuit 130 may be implemented in the earphone 120. More diversified applications can be implemented with the aid of user adjustment.

For earphone manufacturers, how to design filtering coefficient(s) to be applied to their own earphones may be the key to noise cancellation. The related art has to consider materials of respective components and circuit configurations of an earphone when designing the filtering coefficients. If any of these parameters are missed (or ignored), an ideal noise cancellation effect cannot easily be obtained, and expensive precision instrument(s) are then needed for high precision measurement. Through the aforementioned trial and error manner of the present invention, a simple mechanism (or machine) may implement an ideal noise cancellation effect without the need for expensive precision instrument(s). Further, in comparison with the related art, the advantage of the present invention is that sound heard by human ears can be imitated via the feedforward manner, and circuit(s) can be used to generate inverted noise, wherein the inverted noise cancels out the original noise. This means that factors affecting the final broadcast sound due to architecture and materials of an earphone can be eliminated, whereas the related art needs to calculate parameters related to the architecture and materials of an earphone in addition to calculating environmental noise, where calculation of these parameters is extremely demanding.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An audio adjustment method for active noise cancellation, comprising:

obtaining multiple optimal noise cancellation responses of multiple frequencies, comprising:

for each frequency $f_k$ of the multiple frequencies:

broadcasting a single tone having said each frequency $f_k$;

generating M sets of filtering coefficients regarding said each frequency $f_k$, wherein each set of filtering coefficients within the M sets of filtering coefficients comprises a combination of an amplitude and a phase, and the M sets of filtering coefficients are different from one another;

determining a $m^{th}$ set of filtering coefficients from the M sets of filtering coefficients to minimize energy corresponding to said each frequency $f_k$, wherein the amplitude and the phase of the $m^{th}$ set of filtering coefficients represents an optimal noise cancellation response corresponding to said each frequency $f_k$; and adjusting the single tone with the $m^{th}$ set of filtering coefficients to obtain an adjusted single tone corresponding to said each frequency $f_k$; and determining a final set of active noise cancellation coefficients according to the multiple optimal noise cancellation responses of the multiple frequencies.

2. The audio adjustment method of claim 1, wherein the step of adjusting the single tone with the $m^{th}$ set of filtering coefficients to obtain the adjusted single tone corresponding to said each frequency $f_k$ comprises:

utilizing an amplitude and a phase corresponding to the $m^{th}$ set of filtering coefficients to be a frequency response of said each frequency $f_k$; and determining the adjusted single tone according to the frequency response of said each frequency $f_k$.

3. The audio adjustment method of claim 1, wherein the single tone is received by an audio receiver, wherein the audio receiver is installed in an artificial head device, the artificial head device comprises a human ear mechanism, and the audio receiver is installed in the human ear mechanism.

4. The audio adjustment method of claim 1, wherein the energy corresponding to said each frequency $f_k$ is $P_k=E(|c_k*r_m|^2)$, wherein E is a function symbol, $r_m$ is an audio signal received based on the $m^{th}$ set of coefficients, and $c_k$ is a band-pass filtering coefficient.

5. The audio adjustment method of claim 1, wherein an operating environment of the audio adjustment method is an anechoic environment.

6. An audio adjustment device, comprising:

an external audio source, configured to broadcast a single tone;

an earphone;

an artificial head device, comprising an audio receiver, configured to receive the single tone, wherein the earphone is positioned on the artificial head device; and an audio adjustment circuit, coupled to the artificial head device, configured to perform the following operations:

obtaining multiple optimal noise cancellation responses of multiple frequencies, comprising:

for each frequency $f_k$ of the multiple frequencies:

controlling the external audio source to broadcast the single tone having said each frequency $f_k$;

generating M sets of filtering coefficients regarding said each frequency $f_k$, wherein each set of filtering coefficients within the M sets of filtering coefficients comprises a combination of an amplitude and a phase, and the M sets of filtering coefficients are different from one another;

determining a $m^{th}$ set of filtering coefficients from the M sets of filtering coefficients to minimize energy corresponding to said each frequency $f_k$, wherein the amplitude and the phase of the $m^{th}$ set of filtering coefficients represents an optimal noise cancellation response corresponding to said each frequency $f_k$; and adjusting the single tone with the $m^{th}$ set of filtering coefficients to obtain an adjusted single tone corresponding to said each frequency $f_k$ for being broadcast by the earphone; and determining a final set of active noise cancellation coefficients according to the multiple optimal noise cancellation responses of the multiple frequencies.

7. The audio adjustment device of claim 6, wherein the artificial head device comprises a human ear mechanism, and the audio receiver is installed in the human ear mechanism.

8. The audio adjustment device of claim 6, wherein the operations of the audio adjustment circuit further comprise:

utilizing an amplitude and a phase corresponding to the $m_{th}$ set of filtering coefficients to be a frequency response of said each frequency $f_k$; and determining the adjusted single tone according to the frequency response of said each frequency $f_k$.

9. The audio adjustment device of claim 6, wherein the energy corresponding to said each frequency $f_k$ is $P_m=E(|c_k*r_n|^2)$, wherein E is a function symbol, $r_m$ is an audio signal received based on the $m^{th}$ set of coefficients, and $c_k$ is a band-pass filtering coefficient.

* * * * *